US009464473B2

(12) United States Patent
Baldreich

(10) Patent No.: US 9,464,473 B2
(45) Date of Patent: Oct. 11, 2016

(54) ACTUATOR FOR A FLAP ON AN ITEM OF FURNITURE

(71) Applicant: Julius Blum GmbH, Hoechst (AT)

(72) Inventor: Armin Baldreich, Lauterach (AT)

(73) Assignee: JULIUS BLUM GMBH, Hoechst (AT)

( * ) Notice: Subject to any disclaimer, the term of this patent is extended or adjusted under 35 U.S.C. 154(b) by 40 days.

(21) Appl. No.: 14/331,545

(22) Filed: Jul. 15, 2014

(65) Prior Publication Data

US 2014/0317883 A1 Oct. 30, 2014

Related U.S. Application Data

(63) Continuation of application No. PCT/AT2012/000284, filed on Nov. 8, 2012.

(30) Foreign Application Priority Data

Jan. 30, 2012 (AT) ..... 123/2012

(51) Int. Cl.
*E05F 1/12* (2006.01)
*E05F 1/10* (2006.01)
*E05F 1/14* (2006.01)

(52) U.S. Cl.
CPC ..... *E05F 1/1261* (2013.01); *E05F 1/1058* (2013.01); *E05F 1/14* (2013.01);
(Continued)

(58) Field of Classification Search
CPC ..... E05F 1/1261; E05F 1/1058; E05F 1/14; E05F 1/1075; E05F 3/20; E05D 15/262; E05D 3/14; E05D 15/401; E05D 15/46; E05Y 2201/492; E05Y 2201/618; E05Y 2900/20; Y10T 16/5382; Y10T 16/53824; Y10T 16/5383; Y10T 16/53832; Y10T 16/53834; Y10T 16/53864; Y10T 16/547; Y10T 16/304; Y10T 16/2771
USPC ..... 16/280, 282, 286, 287, 289, 302, 366, 16/50, 54; 312/319.2, 319.4; 49/246, 386
See application file for complete search history.

(56) References Cited

U.S. PATENT DOCUMENTS 7,178,202 B2 * 2/2007 Hirtsiefer ..... E05D 3/14 16/286
7,478,891 B2 * 1/2009 Hollenstein ..... E05F 1/1058 312/319.2

(Continued)

FOREIGN PATENT DOCUMENTS

CN 101977533 2/2011
CN 102209828 10/2011

(Continued)

OTHER PUBLICATIONS

Chinese Search Report issued Aug. 17, 2015 in corresponding Chinese Application No. 201280069807.X.

(Continued)

*Primary Examiner* — William Miller
(74) *Attorney, Agent, or Firm* — Wenderoth, Lind & Ponack, L.L.P.

(57) ABSTRACT

An actuator for a flap on an item of furniture includes at least one actuating arm that is mounted to pivot between a closed position and an open position in order to move the flap, a spring device for acting on the actuating arm, and a transmission mechanism for transmitting the force of the spring device onto the actuating arm. An adjustment device allows the transmission mechanism to be shifted between at least two operating positions. In a first operating position, the spring device applies a closing force, in the direction of the closed position, onto the actuating arm which is in an opening position immediately upstream of said closed position. In a second operating position, when said actuating arm is in the aforementioned, immediately-upstream opening position, the spring device exerts a force which acts in the direction of the open position.

17 Claims, 5 Drawing Sheets

(52) U.S. Cl.
CPC ... *E05Y 2201/492* (2013.01); *E05Y 2201/618* (2013.01); *E05Y 2900/20* (2013.01); *Y10T 16/5382* (2015.01); *Y10T 16/5383* (2015.01)

(56) References Cited

U.S. PATENT DOCUMENTS

| | | | | |
|---|---|---|---|---|
| 7,500,287 | B2 * | 3/2009 | Brustle | E05F 1/1075 16/286 |
| 7,562,757 | B2 * | 7/2009 | Dubach | E05F 1/1058 16/319 |
| 7,797,796 | B2 * | 9/2010 | Migli | E05D 15/46 16/286 |
| 7,810,213 | B2 * | 10/2010 | Brustle | E05F 1/1075 16/286 |
| 8,303,055 | B2 * | 11/2012 | Scheffknecht | E05D 15/262 312/319.6 |
| 8,321,996 | B2 * | 12/2012 | Hirtsiefer | E05D 3/14 16/286 |
| 8,356,864 | B2 | 1/2013 | Koenig et al. | |
| 8,468,653 | B2 * | 6/2013 | Tumler | E05D 11/10 16/286 |
| 8,590,107 | B2 * | 11/2013 | Omann | E05D 15/401 16/319 |
| 8,959,709 | B2 * | 2/2015 | Hasegawa | E05D 3/14 16/50 |
| 9,032,768 | B2 | 5/2015 | Hauer | |
| 9,181,743 | B2 * | 11/2015 | Kashiwaguma | E05D 15/40 |
| 2001/0039762 | A1 * | 11/2001 | Giovannetti | E05F 1/1091 49/246 |
| 2004/0239213 | A1 * | 12/2004 | Hirtsiefer | E05D 15/262 312/109 |
| 2008/0121490 | A1 * | 5/2008 | Dubach | E05F 1/1058 192/17 D |

FOREIGN PATENT DOCUMENTS

| | | |
|---|---|---|
| DE | 102 03 269 | 8/2003 |
| DE | 20 2007 006 690 | 10/2008 |
| EP | 2 290 182 | 3/2011 |
| JP | 7-48970 | 2/1995 |
| WO | 2007/112800 | 10/2007 |

OTHER PUBLICATIONS

International Search Report (ISR) issued Mar. 1, 2013 in International (PCT) Application No. PCT/AT2012/000284.
Austrian Office Action issued Sep. 6, 2012 in Austrian Patent Application A 123/2012.

* cited by examiner

ACTUATOR FOR A FLAP ON AN ITEM OF FURNITURE

The present invention concerns an actuator for a flap of an article of furniture comprising at least one actuating arm mounted pivotably between a closed position and an open position to move the flap, a spring device for acting on the actuating arm and a transmission mechanism for transmitting the force of the spring device to the actuating arm.

In addition, the invention concerns an article of furniture comprising a furniture carcass and a flap which is mounted moveably relative to the furniture carcass and which is mounted moveably by an actuator of the kind to be described.

DE 102 03 269 A1 describes a fitment device for a furniture flap, wherein a pivotably mounted actuating arm is acted upon by a spring device in the form of a gas pressure spring. The actuating arm or the flap connected thereto is held in the closed position by the force of the gas pressure spring with a closing force, so that the flap is held closed and unintentional opening is prevented. After passing through a dead center position, the gas pressure spring exerts an upwardly holding torque on the flap so that the flap is held in place in an open position. A disadvantage there is that, when the flap is opened, a user or an ejection device which is possibly provided has to apply a considerable force in order to overcome the closing force exerted by the gas pressure spring. In addition, that fitment device is adapted to always exert a closing force on the actuating arm in the last region of the closing movement.

The object of the present invention is to provide an actuator of the general kind set forth in the opening part of this specification, while avoiding the above disadvantages.

That object is attained by the features according to a first aspect of the invention. Further advantageous configurations of the invention are recited in the appendant claims.

It is therefore provided that there is provided a shifting device, by which the transmission mechanism is displaceable between at least two operating positions, wherein in a first operating position, the spring device acts on the actuating arm in an open position immediately preceding the closed position with a closing force in the direction of the closed position, and wherein in a second operating position, the spring device exerts a force acting in the direction of the open position in the said immediately preceding open position of the actuating arm.

The above-mentioned "immediately preceding open position" of the actuating arm can be within an angle range of between 2° and 8°, starting from its closed position, wherein it is preferably provided that the angle is 5°.

In other words, the transmission mechanism has at least two operating positions which a person can freely select by manual actuation of the shifting device. In a first operating position, the actuating arm is acted upon with a closing force by the spring device in or near the closed position—preferably with an opening angle of the actuating arm of between 0° and 8°—so that therefore the actuating arm or the flap connected thereto is restrained in the closed position.

In a second operating position, in contrast, the actuating arm can be acted upon with an opening force by the spring device in or near the closed position so that the actuating arm or the flap connected thereto either already moves in the direction of the open position, starting from the closed position of the actuating arm, or is moved in the direction of the open position, possibly after overcoming a slight closing force. A user therefore does not have to apply any force, or only an immaterial force, for opening the flap, the opening movement of the actuating arm or the flap being assisted by the spring device. That operating position is advantageous in particular also when an ejection device having a Touch-Latch-functionality is arranged for ejecting the furniture flap from the closed end position, so that this ejection device has to overcome only a slight force from the spring device when opening the flap.

The shifting device provides therefore that one and the same actuator can be used for different operating modes or uses, without a specific actuator being required for that purpose for each use. For example, the actuator can be equally used for standard applications (retracting the flap into the closed end position) and also for Touch-Latch applications (ejecting the flap from the closed end position). The transmission mechanism is displaceable by the shifting device between at least two operating positions in which the actuating arm can be acted upon in or near the closed position (between 0° and 8° angle of opening) with different biasing forces from the spring device. In that respect, it can be provided that:

- in a first operating position, the actuating arm can be acted upon with a closing force by the spring device in or near the closed position,
- in a second operating position, the actuating arm can be acted upon with a force acting in the direction of the open position by the spring device in or near the closed position, and
- in a modified second operating position, the actuating arm can be acted upon in or near the closed position by the spring device with a closing force which is less—in relation to the first operating mode.

For that operating position, in which the actuating arm is acted upon with an opening force in or near the closed position, there can be provided a restraining device which holds the actuating arm or the flap connected thereto in the closed position (that is to say in position relative to the furniture carcass) so that unintentional opening of the actuating arm or the flap is therefore prevented.

BRIEF DESCRIPTION OF THE DRAWINGS

Further details and advantages of the present invention will be described by means of the embodiment by way of example illustrated in the Figures in which.

DETAILED DESCRIPTION OF THE INVENTION

Figure 1:
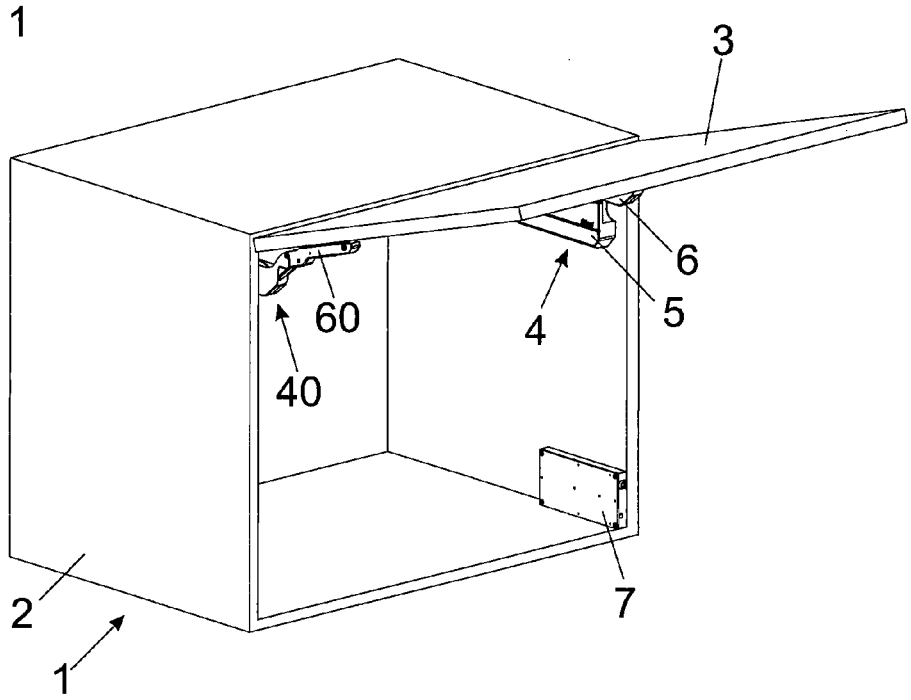
FIG. 1 shows a perspective view of an article of furniture, wherein a flap is mounted upwardly moveably by way of actuators relative to a furniture carcass.

FIG. 1 shows an article of furniture 1 with a flap 3 mounted moveably by way of actuators 4, 40 fixed at both sides to the furniture carcass 2. The actuators 4, 40 each have an actuating arm 6, 60 mounted pivotably about a horizontal axis for moving the flap 3 so that the flap 3 is mounted moveably upwardly relative to the carcass 2 about a horizontally extending pivot axis. The actuator 4 has a housing 5 for mounting to the furniture carcass 2. It is possible to see a diagrammatically indicated restraining device 7 which can be provided for that operating position in which the actuators 4, 40, in or near the closed position of the actuating arms 6, 60, exert an opening force on the actuating arm 6, 60 so that unwanted opening of the flap 3 is prevented.

For that purpose, the restraining device 7 may include at least two parts, wherein a first part is arranged on the furniture carcass 2 and a second part is arranged on the flap 3, wherein those two parts, in the closed position of the flap 3, exert a magnetic attraction force on each other. In that arrangement, the restraining device 7 can have an ejection element which is acted upon by a force storage means and by which the flap 3 is moveable into a open position after unlocking of that force storage means has been effected (in its function as an auxiliary drive). The magnetic holding force of the restraining device 7 can be overcome by the force storage means of the restraining device 7, whereupon the flap 3 is further moveable into an open position by the force of a spring device (FIG. 2) of the actuators 4, 40.

Alternatively or additionally, it is possible for the restraining device 7 to have a housing with a reversing loop provided thereon or a heart-curve, wherein a control pin arranged on the flap 3 is guided displaceably along that reversing loop or heart-curve and can be guided into a releasable locking position. That locking position can be released again by manually exerting a pressing and/or pulling force on the flap 3, whereupon the flap 3 is moveable into an open position by the force of a spring device 9 (FIG. 2) of the actuators 4, 40. Such releasable locking arrangements are already known in connection with Touch-Latch devices and do not need to be described in greater detail at this juncture. In the illustrated embodiment, the restraining device 7 is arranged separately from the actuators 4, 40 on the furniture carcass 2 but it can also be in the form of an inherent functional unit of the actuators 4, 40.

Figure 2:
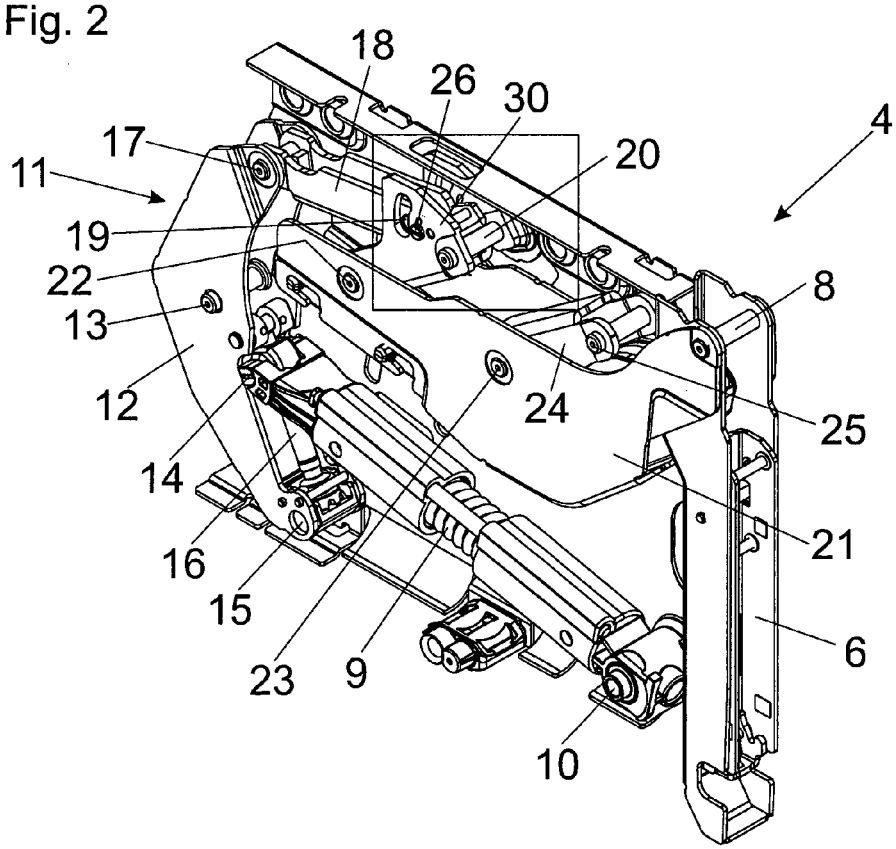
FIG. 2 shows a perspective view of an embodiment of an actuator.

FIG. 2 shows a perspective view of a possible embodiment of an actuator 4. In the illustrated Figure, the actuating arm 6 is in the closed position and is mounted pivotably about a moving, horizontally extending axis member 8. The actuator 4 has a spring device 9 which is supported on the one hand at a stationary spring base 10 and which on the other hand acts on the actuating arm 6 by way of a transmission mechanism 11. The spring device 9 has at least one coil spring—preferably a compression spring. In the illustrated embodiment, the transmission mechanism 11 includes a double-armed deflection lever 12 mounted pivotably about a stationary axis member 13. At an end of the deflection lever 12, the spring device 9 engages a pivot mounting point 14, wherein the pivot mounting point 14 of the spring device 9 is displaceable by an adjusting device 15 along a threaded spindle 16 relative to the axis member 13 of the deflection lever 12 and thus the force of the spring device 9 acting on the actuating arm 6 is adjustable for selective weight compensation of the flap 3. Hingedly connected to the other end of the deflection lever 12 by way of a moving axis member 17 is a lever 18 which in turn is connected to a further lever 30 by way of a hinge axis 19. The lever 30 is mounted pivotably about a stationary axis member 20. A main lever 21 is connected by way of moving axis member 22 to the lever 30 and is in turn connected to a hinge lever 24 by way of a moving axis member 23. The hinge lever 24 is pivotable about a stationary axis member 25. The main lever 21 is connected to the actuating arm 6 by way of the moving pivot axis member 8.

A shifting device 26 is of relevance, having an adjusting screw 27 by which the location of the hinge axis 19—which establishes the axis of rotation between the two levers 18 and 30—is displaceable, whereby the different operating positions of the transmission mechanism 11 can be selected. The motion characteristic of the actuator 4 can be altered by a displacement of the position of the hinge axis 19 relative to the two axis members 17, 20, produced by the shifting device 26, as is also described and shown in the following Figures.

Figure 3A:
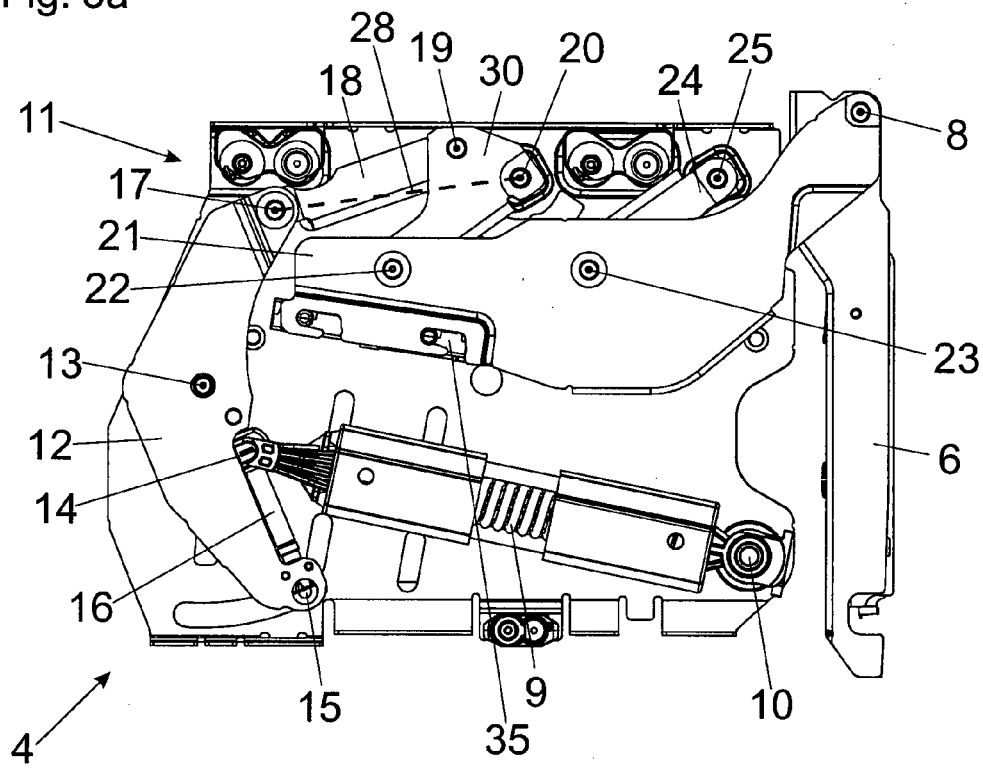
FIGS. 3*a*, 3*b* show side views of the actuator in two different operating positions.

FIG. 3*a* shows a side view of the actuator 4, the shifting device 26 not being shown for the sake of clarity. The position of the hinge axis 19 corresponds to the first operating position of the transmission mechanism 11, wherein therefore the spring device 9 acts on the actuating arm 6 with a closing force in the closed position and in the specified immediately preceding open position. The motion characteristic of the transmission mechanism 11 is determined by way of the positions of the axis member 17, the hinge axis 19 and the axis member 20. To illustrate the situation, a line of force action 28 is shown as a broken line between the moving axis member 17 and the axis member 20 which is fixed with respect to the housing, in which respect it can be seen from FIG. 3*a* that the displaceably mounted hinge axis 19 is relatively widely spaced from the line of force action 28. In that first operating position, the actuating arm 6, in the closed position and in an open position immediately preceding the closed position, is acted upon by the spring device 9 with a closing force in the direction of the closed position. After the hinge axis 19 has moved beyond the line of force action 28 the spring device 9 exerts a force acting in the direction of the open position on the actuating arm 6. The actuator 4 also has a damping device 35 in the form of a fluid damper (preferably a piston-cylinder unit) which damps the closing movement of the flap 3.

Figure 3B:
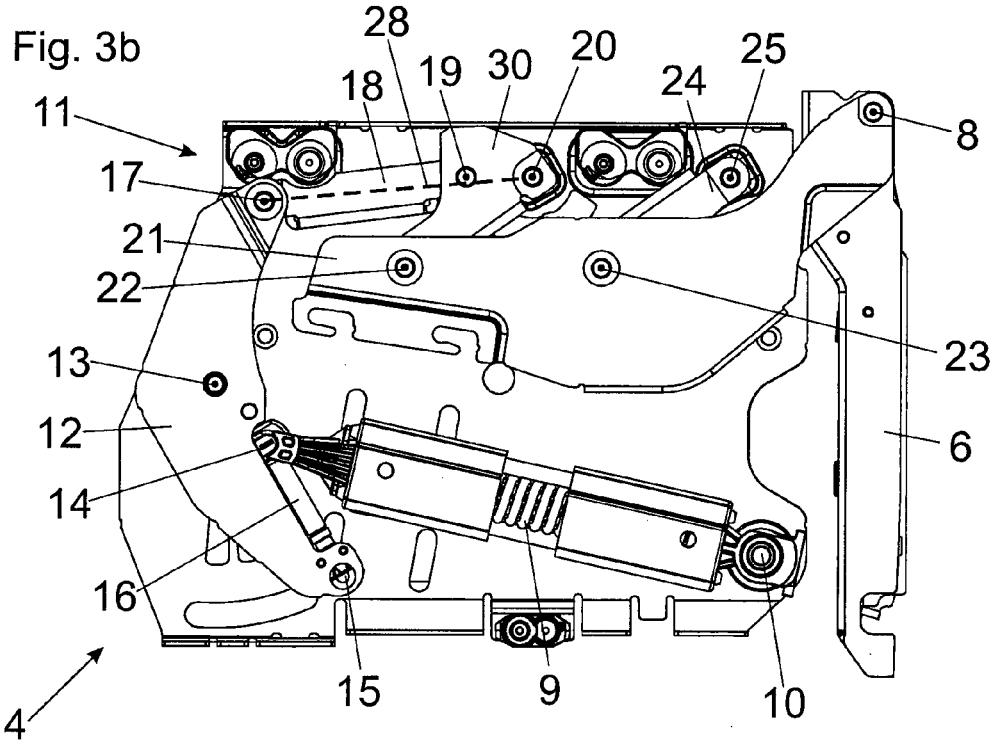

FIG. 3*b* in contrast shows that position of the hinge axis 19, that corresponds to the second operating position of the transmission mechanism 11, wherein therefore the spring device 9 exerts a force acting in the direction of the open position on the actuating arm 6 in the above-mentioned immediately preceding open position of the actuating arm 6. The location of the displaceable hinge axis 19 is disposed in the closed position of the actuating arm 6 in comparison with FIG. 3*a* substantially closer to the line of force action 28. Admittedly, in the illustrated completely closed position of the actuating arm 6, a slight closing force is still exerted on the actuating arm 6 by the spring device 9, immediately after actuation of the actuating arm 6 in the direction of the open position, the hinge axis 19 is instantly moved beyond the line of force action 28. In the above-mentioned immediately preceding open position of the actuating arm 6 (for example from a 5° angle of opening), the actuating arm 6 is therefore already urged in the direction of the open position by the spring device 9. If adjustment of the hinge axis 19 is effected in such a way that, in the completely closed position of the actuating arm 6, it comes to lie below the line of force action 28 shown in FIGS. 3*a* and 3*b*, then the actuating arm 6 already has an opening action starting from the closed position. In this case, however, there is to be provided a restraining device 7 (FIG. 1) so that the flap 3 is sufficiently stably held in the closed end position relative to the furniture carcass 2. Therefore, the location of the hinge axis 19 relative to the line of force action 28, which corresponds to a notional connecting line between the axis members 17 and 20, is displaceable towards and away from same by the shifting device 26, preferably in a direction extending approximately orthogonally relative to the line of force action 28.

Figure 4A:
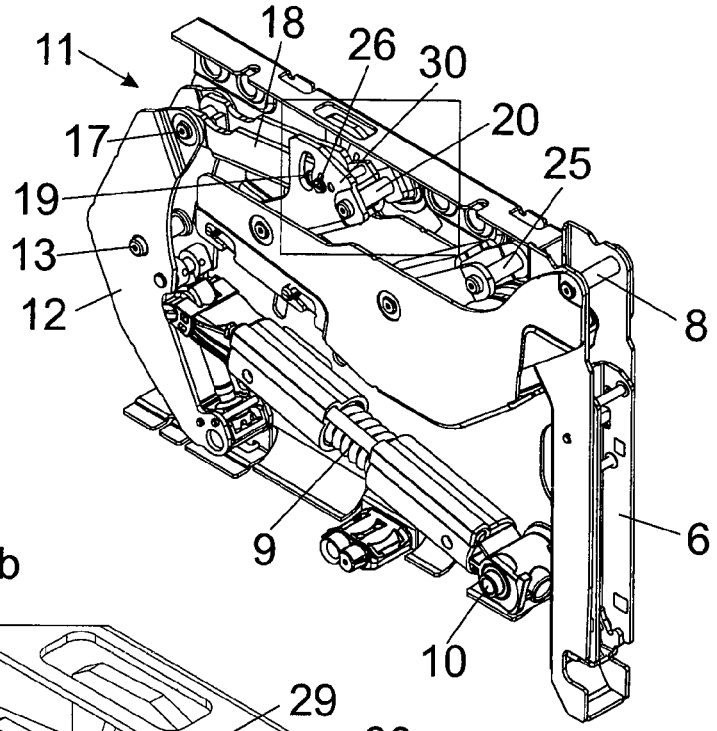
FIGS. 4*a*-4*c* show a perspective view of the actuator and detail views of the shifting device in two different operating positions.
Figure 4B:
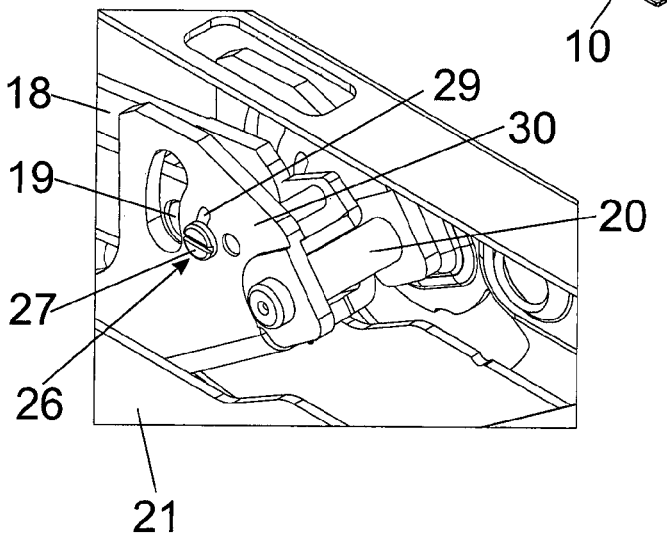

FIG. 4*a* shows a perspective view of the actuator 4, wherein the region of the shifting device 26 for setting the various operating positions of the transmission mechanism 11 is shown in a framed view. FIG. 4*b* shows that detail region on an enlarged scale, wherein the position of the hinge axis 19 in FIG. 4*b* corresponds to the second operating position of the transmission mechanism 11, in which case the force of the spring device 9 acts on the actuating arm 6 in opening relationship as from the above-mentioned immediately preceding open position of the actuating arm 6 (preferably from an angle of opening of 5°). In the illustrated embodiment, the shifting device 26 includes an adjusting screw 27, by which the location of the hinge axis 19 can be adjusted and/or fixed. The adjusting screw 27 is mounted displaceably within a—preferably slot-shaped—guide 29 of the lever 30, the displaceability of the adjusting screw 27 being limited by the contour and length of the guide 29. In the illustrated embodiment, the adjusting screw 27 is in the form of a fixing screw so that, to adjust the location of the hinge axis 19, the adjusting screw 27 is firstly released, the location of the hinge axis 19 is pre-positioned and then the adjusting screw 27 is re-tightened. It will be appreciated that it is also in accordance with the invention that a rotary movement of the adjusting screw 27 is converted into a linear movement of the hinge axis 19 by way of a transmission arrangement (not shown here), for example by way of a self-locking worm transmission, an eccentric and/or a rack-and-pinion arrangement.

Figure 4C:
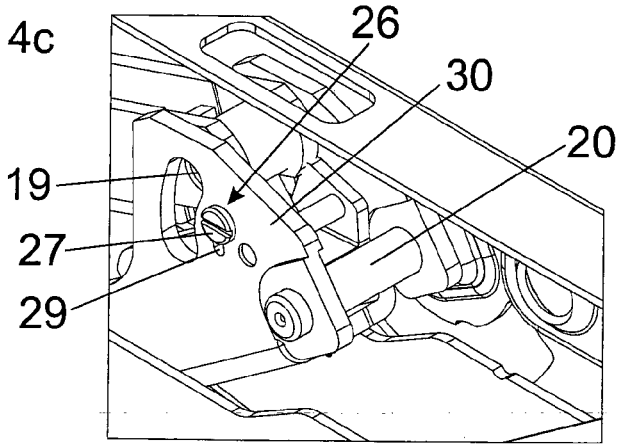

FIG. 4*c* in contrast shows a location, displaced in comparison with FIG. 4*b*, of the adjusting screw 27 or the hinge axis 19, that corresponds to the first operating position of the transmission mechanism 11, in which case the spring device 9 exerts a closing force on the actuating arm 6 in the closed position and in the above-mentioned immediately preceding open position of the actuating arm 6. It will be noted that the location of the adjusting screw 27, in comparison with FIG. 4*b*, is at the other end of the guide 29, whereby the location of the hinge axis 19 is also raised and is thus further away from the line of force action 28 (FIG. 3*a*).

Figure 5A:
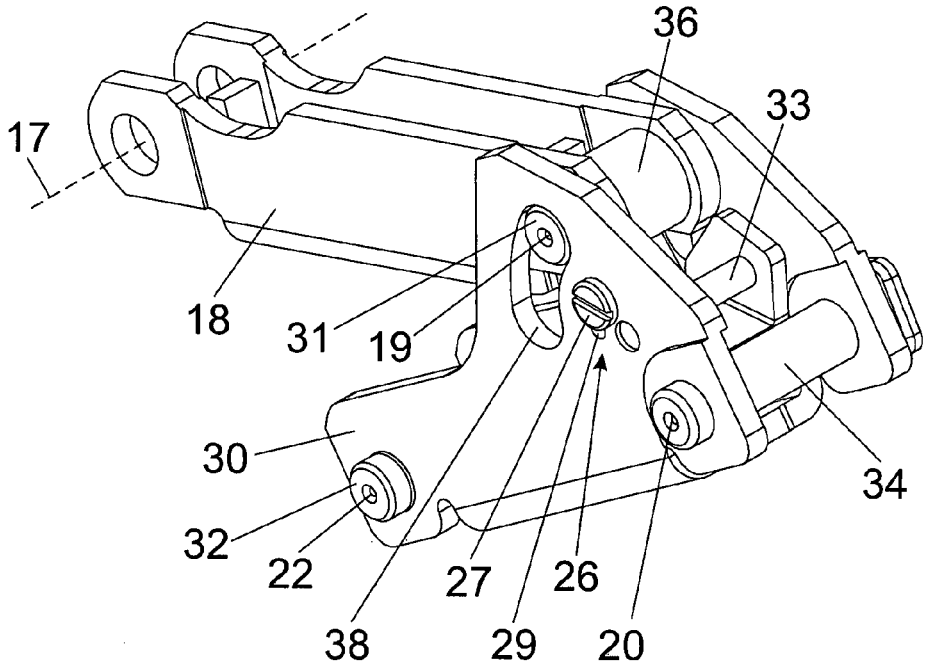
FIGS. 5*a*, 5*b* show the shifting device of the actuator in the assembled condition and as an exploded view.

FIG. 5*a* shows the shifting device 26 operative between the levers 18 and 30 for adjusting the hinge axis 19. In the assembled condition, the lever 18 is connected to the direction-changing lever 12 (FIG. 4*a*) by way of the moving axis member 17, while the moving axis member 22 of the lever 20 is connected to the main lever 21 (FIGS. 3*a* and 3*b*). The lever 30 is mounted pivotably about an axis member 20 fixed with respect to the housing. By releasing the adjusting screw 27 and pre-positioning it along the guide 29, the location of the hinge axis 19 can be adjusted, whereby the different operating positions of the actuator 4 can be set. After positioning of the adjusting screw 27 has been effected, the location of the hinge axis 19 can be fixed again by tightening the adjusting screw 27.

Figure 5B:
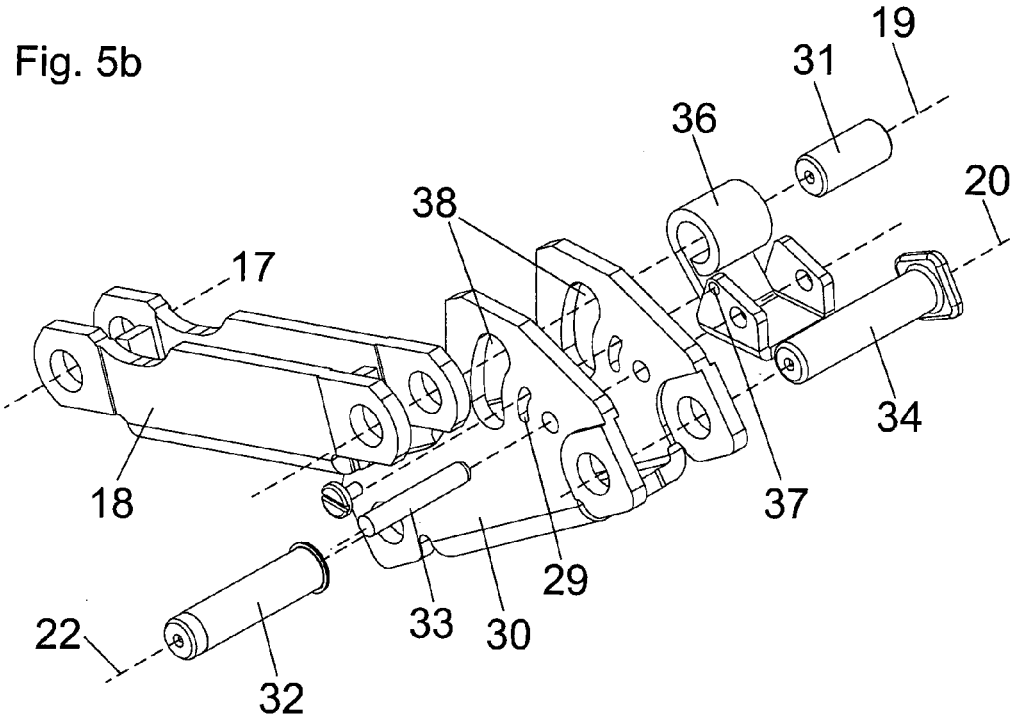

FIG. 5*b* shows an exploded view of the components shown in FIG. 5*a*. Mounted to the hinge axis 19 is a pin 31 which connects a pivotal portion 36 to the lever 18. The pivotal portion 36 is mounted pivotably to the lever 30 by way of a further pin 33. In the assembled condition, the adjusting screw 27 passes through the slot-shaped guide 29 in the lever 30 and engages into a corresponding opening 37 in the pivotal portion 36. In addition, the arrangement has a pin 32 mounted to the axis member 22 (for connection to the main lever 21, see FIGS. 3*a* and 3*b*), as well as a pin 34 mounted to the axis member 20 (for connection of the lever 30 to the housing 5 of the actuator 4). The pin 31 mounted to the hinge axis 19 is mounted limitedly displaceably within or along preferably curved guide tracks 38 of the lever 30 (FIG. 5*a*) and can be positioned by adjustment of the adjusting screw 27, preferably also at predetermined locations.

Figure 6:
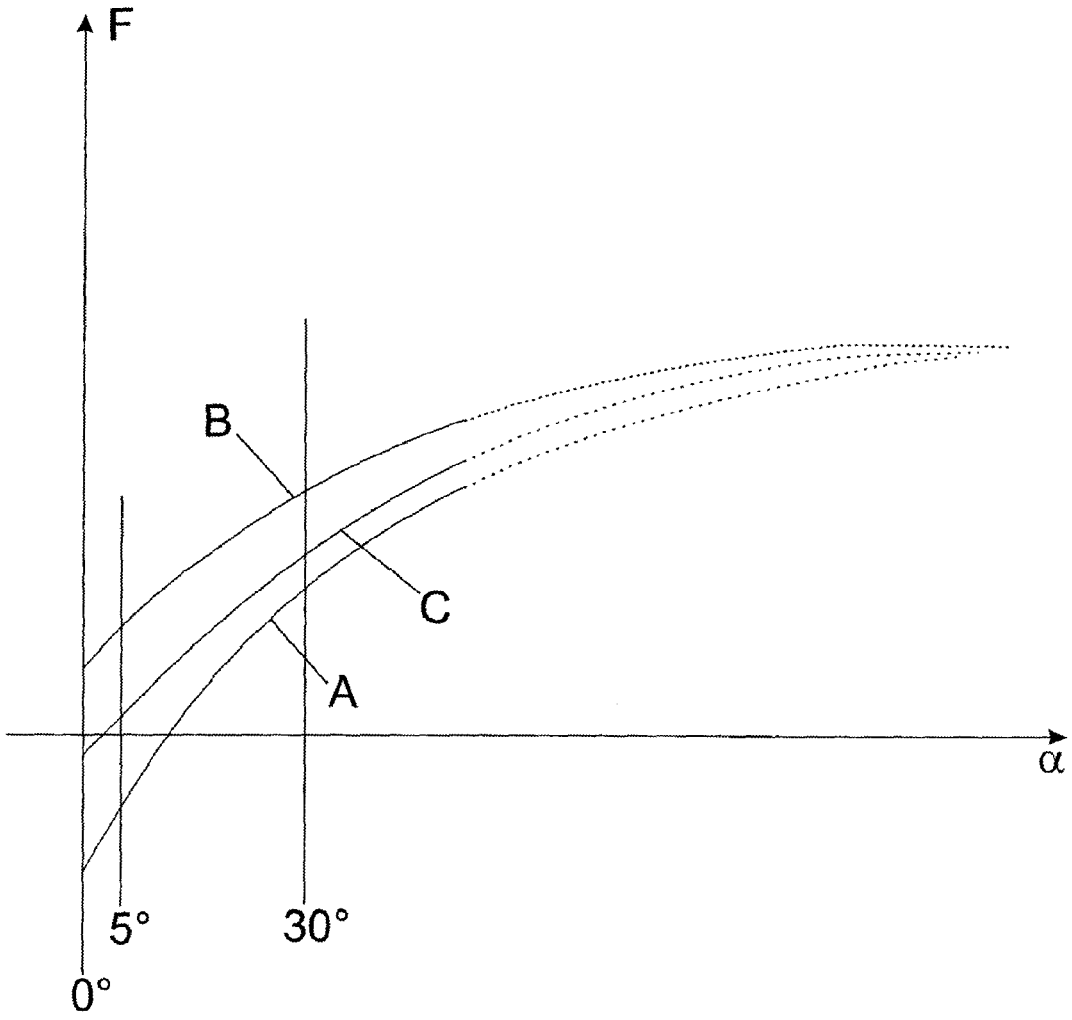
FIG. 6 shows a graph with characteristic curves in respect of the spring force in the various operating positions in dependence on the angle of opening of the actuating arm.

FIG. 6 shows a graph of the spring force (F) acting on the actuating arm 6 in dependence on the angle of opening ($\alpha$) of the actuating arm 6. The characteristic curve (A) describes by way of example a first operating position of the transmission mechanism 11, wherein in the closed position of the actuating arm 6—with $\alpha$ equal to 0°—a closing force acts on the actuating arm 6, with an angle of opening of 5° a closing force also acts on the actuating arm 6 so that therefore the flap 3 is pulled into the closed end position in the closing movement in the last closing region and is held in the closed end position with a predetermined closing force.

The characteristic curve (B) describes the possibility of a second operating position of the transmission mechanism 11, wherein in the closed position of the actuating arm 6—with $\alpha$ being equal to 0° and with $\alpha$ equal to 5°—an opening force is exerted on the actuating arm 6 by the spring device 9 so that therefore an opening force acts on the actuating arm 6 over the entire opening angle range.

The characteristic curve (C) describes by way of example a modified second operating position of the transmission mechanism 11, wherein in the closed position of the actuating arm 6 (with $\alpha$ equal to 0°) a lower closing force acts on the actuating arm 6—in comparison with the characteristic curve (A) with the first operating position—so that the actuating arm 6 is admittedly held in the closed position but after passing through a dead center point position (for example from an angle of opening of $\alpha$ equal to 5°) it is moved in the direction of the open position by the force of the spring device 9. Opening is already effected at 5°.

The shifting device 26 permits transposition of the respective operating positions in a rest condition of the actuating arm 6. The location of the displaceable hinge axis 19 can also be fixed at two or more predetermined locations or latching positions which correspond to the respective operating positions, wherein it is also possible to implement fine tuning on site by the adjusting screw 26—in dependence on the respective weight of the flap 3—. Adjustment of the spring force acting on the actuating arm 6 for compensation of the weight of the flap is effected by the adjusting device 15 described with reference to FIG. 2, wherein the force of the spring device 9 on the actuating arm 6 can also be so adjusted that the flap 3 connected to the actuating arm 6 is not pivoted upwardly by itself but is held in position in an open position by the preset force of the spring device 9.

The invention claimed is:

1. An actuator for a flap of an article of furniture comprising:

at least one actuating arm mounted pivotably between a closed position and an open position to move the flap;

a spring device for acting on the actuating arm;

a transmission mechanism for transmitting the force of the spring device to the actuating arm; and a shifting device, by which the transmission mechanism is displaceable between at least two operating positions, wherein in a first operating position, the spring device acts on the actuating arm in an open position immediately preceding the closed position with a closing force in the direction of the closed position, and wherein in a second operating position, the spring device exerts a force acting in the direction of the open position in the immediately preceding open position of the actuating arm, and wherein the transmission mechanism has at least two levers connected together by way of a hinge axis, and the position of the hinge axis is displaceable by the shifting device.

2. The actuator according to claim 1, wherein the immediately preceding open position of the actuating arm is within an angle range of between 2° and 8° starting from its closed position.

3. The actuator according to claim 2, wherein the immediately preceding open position of the actuating arm is 5° starting from its closed position.

4. The actuator according to claim 1, wherein the position of the hinge axis is displaceable between a first location corresponding to the first operating position and at least one second location corresponding to the second operating position.

5. The actuator according to claim 1, wherein one of the at least two levers has a moving axis member and another of the at least two levers has an axis member which is fixed with respect to the housing, and wherein the location of the hinge axis relative to a line of force action corresponding to a notional connecting line between the moving axis member and the fixed axis member is displaceable towards and away from the line of force action by the shifting device.

6. The actuator according to claim 1, wherein the location of the hinge axis is continuously displaceable or can be positioned at predetermined locations by the shifting device.

7. The actuator according to claim 1, wherein the shifting device has an adjusting screw, by which the location of the hinge axis is adjustable and/or can be fixed.

8. The actuator according to claim 1, wherein one of the at least two levers has a guide, and wherein the adjusting screw can be positioned along the guide.

9. The actuator according to claim 8, wherein the guide is slot-shaped.

10. The actuator according to claim 1, wherein mounted on the hinge axis is a pin hingedly connected to one of the at least two levers by way of a pivotal portion.

11. The actuator according to claim 10, wherein another of the at least two levers has a guide track, and wherein the pin is mounted limitedly displaceably along or within the guide track.

12. The actuator according to claim 1, wherein the transmission mechanism is displaceable by the shifting device into a modified second operating position in which the actuating arm is acted upon in or near the closed position by the spring device with a closing force which is less than the closing force in the first operating position.

13. The actuator according to claim 1, wherein further comprising a restraining device by which the actuating arm or the flap connected to the actuating arm is held in the closed position.

14. The actuator according to claim 1, further comprising a damping device which damps the closing movement of the flap.

15. The actuator according to claim 14, wherein the damping device is a fluid damper.

16. An article of furniture according to claim 1, comprising:

a furniture carcass;

and the flap which is mounted moveably relative to the furniture carcass and which is mounted moveably by the actuator.

17. The article of furniture according to claim 16, wherein the flap is mounted moveably upwardly about a horizontally extending pivot axis relative to the furniture carcass.

* * * * *